United States Patent [19]

Tschudy et al.

[11] Patent Number: 4,480,414

[45] Date of Patent: Nov. 6, 1984

[54] BUILDING CONSTRUCTION

[76] Inventors: Donald B. Tschudy, 716 - 37th St., NW., Canton, Stark County, Ohio 44709; Richard D. Tschudy, 225 Woodrow St., NW., North Canton, Stark County, Ohio 44720

[21] Appl. No.: 422,677

[22] Filed: Sep. 24, 1982

[51] Int. Cl.[3] ..... E04B 7/00

[52] U.S. Cl. ..... 52/82; 52/236.1; 52/DIG. 10

[58] Field of Search ..... 52/236.1, 236.2, 79.4, 52/245, 639, 643, 81, 82, DIG. 11, DIG. 14, DIG. 10

[56] References Cited

U.S. PATENT DOCUMENTS

| | | | |
|---|---|---|---|
| 185,889 | 1/1877 | Boorman | 52/81 |
| 240,868 | 5/1881 | Waters | 52/81 |
| 844,212 | 2/1907 | Thaden | 52/643 |
| 2,886,855 | 5/1959 | Petter | 52/79.4 |
| 3,152,366 | 10/1964 | McCrory et al. | 52/79.4 |
| 3,646,718 | 3/1972 | McKenna | 52/79.4 |
| 3,791,080 | 2/1974 | Sjoberg | 52/79 |
| 3,854,255 | 12/1974 | Baker | 52/81 |
| 4,146,997 | 4/1979 | Diethorn | 52/236.2 |
| 4,173,857 | 11/1979 | Kosaka | 52/643 |

FOREIGN PATENT DOCUMENTS 2414104 1/1978 France .

OTHER PUBLICATIONS

S. Paulson Edifice, patented 10/3/61 Des. 191,438.

*Primary Examiner*—John E. Murtagh
*Assistant Examiner*—Andrew Joseph Rudy
*Attorney, Agent, or Firm*—Frease & Bishop

[57] ABSTRACT

A hexagonal housing unit is erected with flat roof and side wall panels of different shapes, formed of selected desired building materials, and manufactured by production procedures. Certain of the panels may be formed of two pieces or sections. There are several sizes of certain panels to accommodate multiple unit installations either initial or by add-on construction. Simple joints, preferably bolted, connect the panels and proper roof drainage is enabled in multiple unit buildings.

4 Claims, 26 Drawing Figures

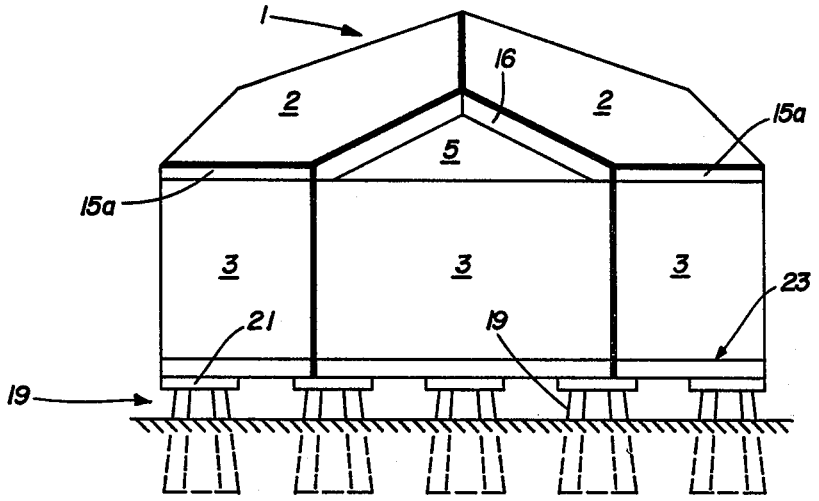
FIG. 1
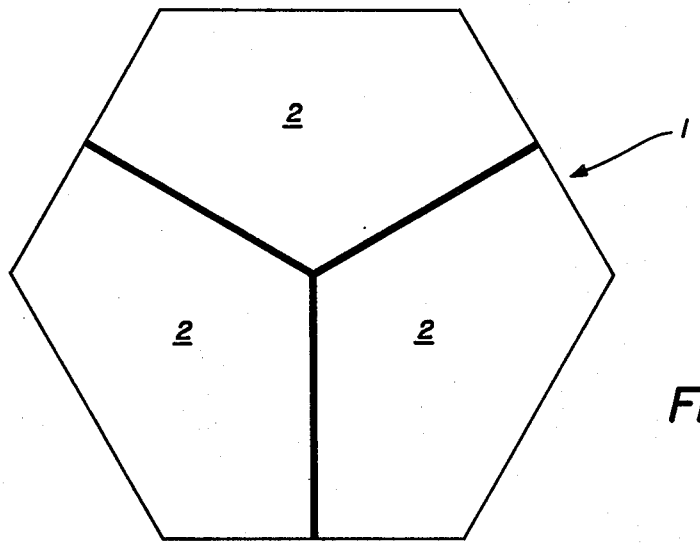
FIG. 2
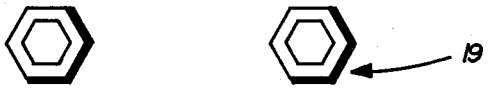
FIG. 3
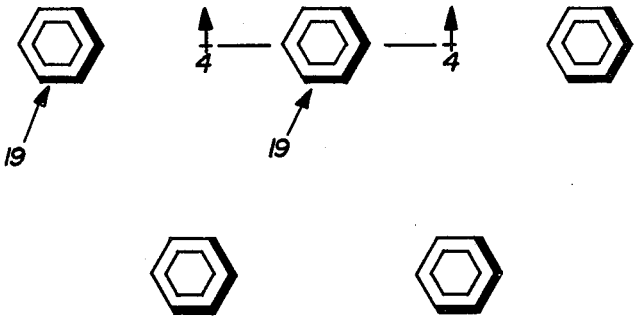

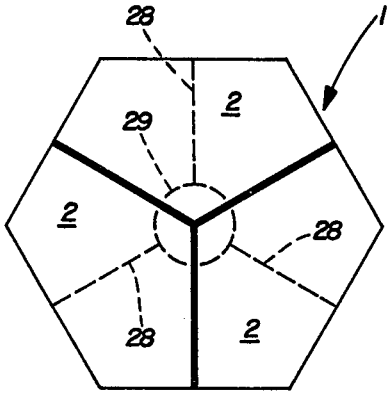
FIG. 26
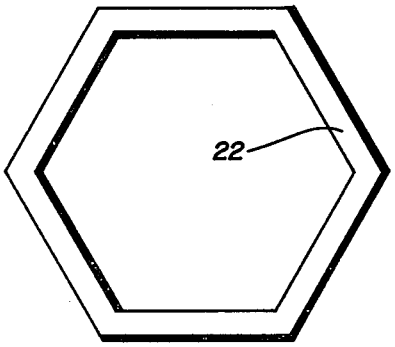
FIG. 3A
FIG. 6
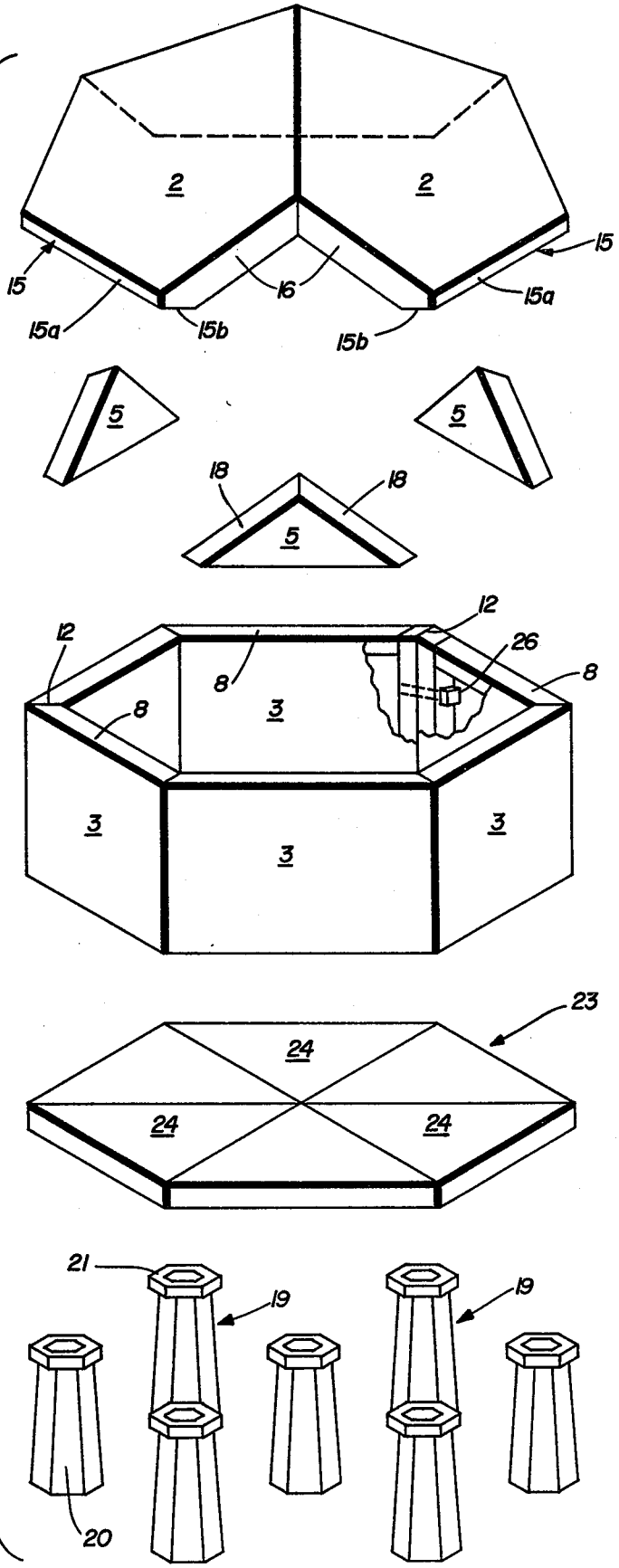

FIG. 19
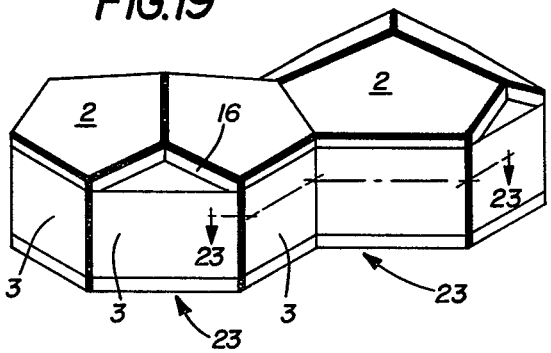
FIG. 20
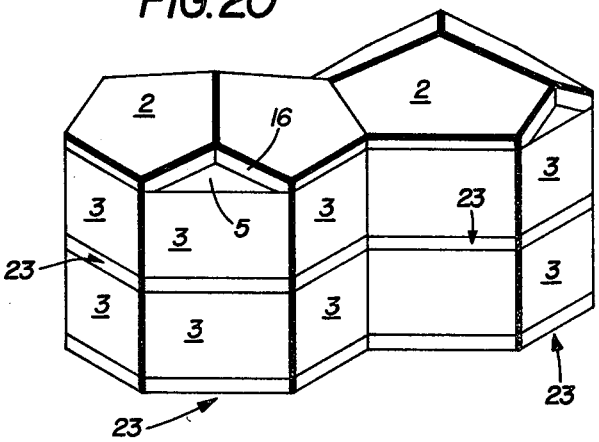
FIG. 23
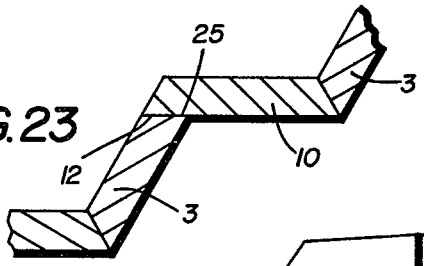
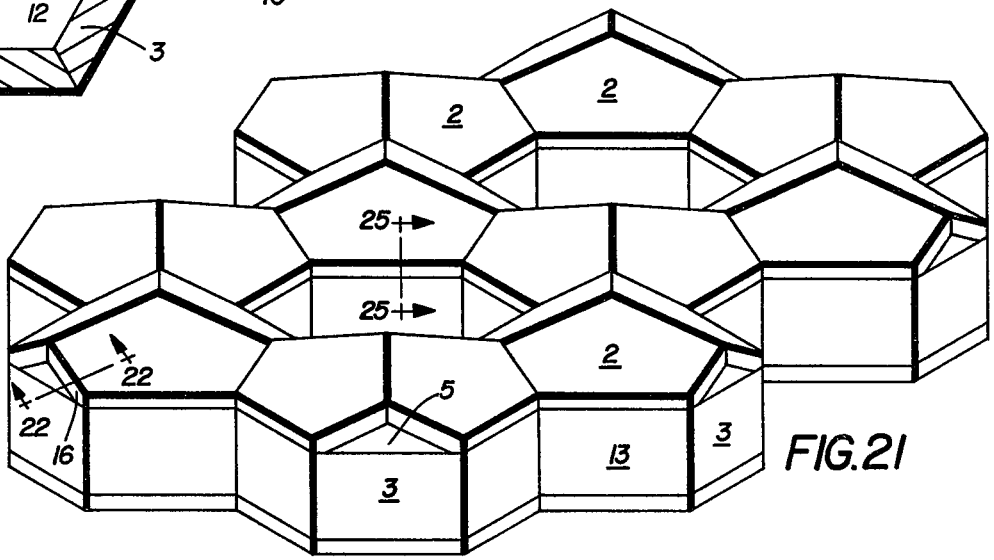
FIG. 21
FIG. 22
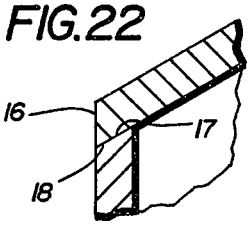
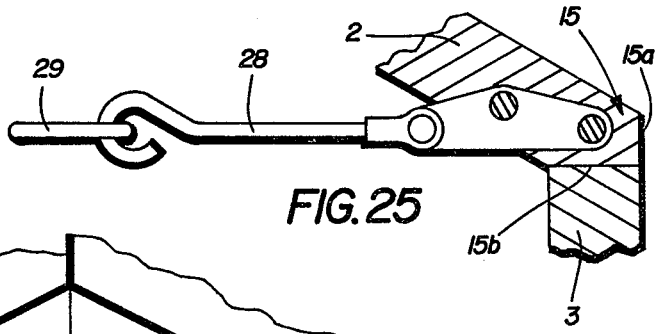
FIG. 25
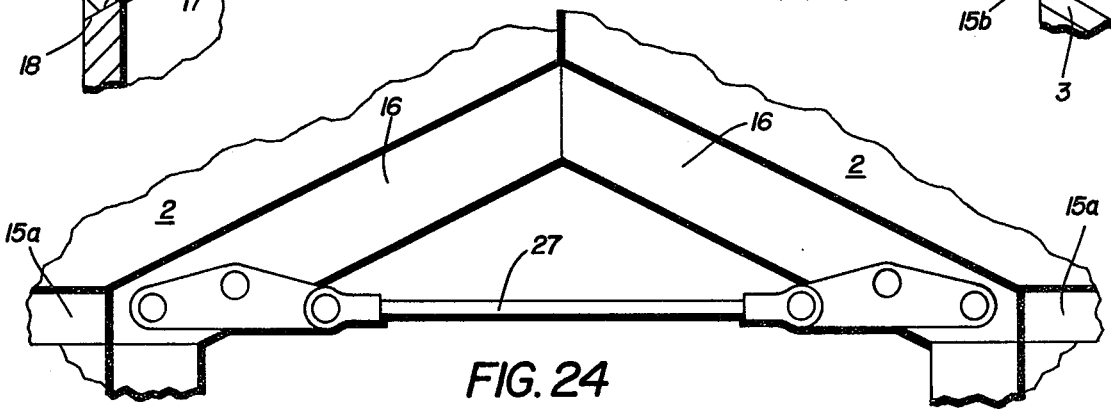
FIG. 24

BUILDING CONSTRUCTION

BACKGROUND OF THE INVENTION

1. Field of the Invention

The invention relates to the construction of a hexagonal building unit, and more particularly to a primary hexagonal unit that is economical to manufacture and is composed of a number of different flat building panel wall and roof elements which may be assembled to form the primary unit, which elements are readily shipped or transported from fabricating facilities to erection locations, are simple to erect, and are adapted for location in different terrains and climates for housing, storage or other utilization.

Further, the invention relates to such primary hexagonal units which may be erected in connected multiples, which may be supported on various types of foundations, which are attractive in appearance, which are inherently strong and wind and shock resistant, and which have roofs of multiple connected units having ability to shed water and snow.

Further, the various flat panel elements of the basic unit may be formed of usual current and new building materials and may be manufactured using simple and inexpensive production procedures. Finally, the new construction may be used to construct either single or multistory buildings to which additional basic units readily may be added.

2. Description of the Prior Art

There are many examples in the prior art of hexagonally or other angularly shaped building components which have been combined in multiples to form buildings. However, some of such prior art buildings require framework structures to which wall and roof components must be connected with special fastening devices. Often special costly sealing means is required where the components are fastened. Such seals are subject to sun deterioration, leaks, etc., and joints between components often are difficult to cover.

Most other prior art buildings when erected in multiples have roofs which do not have complete perimeter water and snow shedding capability. Furthermore, the components of such prior art buildings frequently are large, resulting in high manufacturing, shipping and storage costs which are not economical.

Further, it is quite difficult to add primary components to some of such prior art structures and others involve internal columns which obstruct living space in multiple unit buildings.

Accordingly, there is an existing need for low cost buildings that may be erected from simple panel elements which may be fabricated readily at a manufacturing facility and which also may be easily stored or shipped to any desired erection location where single or multiple hexagonal units are to be erected on various selected kinds and types of foundations without requiring large erection cranes and the like, and which units when erected in multiples have perimeter water and snow shedding characteristics.

SUMMARY OF THE INVENTION

Objectives of the invention include providing a primary hexagonal building unit construction formed of a series of one or more different flat panel elements which are economical to manufacture, store and ship; providing such primary unit construction in which the flat panel elements, depending on their size, shape or composition, may be constructed of various types and kinds of building materials, and also may be manufactured in one or more sections; providing such primary unit construction in which the flat panel elements are readily assembled by connecting together abutted flat edge, end or panel face portions or surfaces adjacent such edges with simple connector devices, such as bolts or the like, thereby providing joints between abutted surfaces that may be sealed, covered or enclosed with effective, efficient and durable sealing means or enclosure materials; providing such primary hexagonal unit construction which may be erected as single or multiple units, either as built or by adding additional primary units from time to time in any selected number, arrangement or pattern, and having single or multiple stories or floors; providing such primary single or multiple unit building construction which may be erected on various selected types of foundations located in various terrains and climates; providing such hexagonal building unit construction in which additions to erected primary units may be made by simple removal of and addition of one or more of the flat panel elements characterizing the construction; and providing such building construction which achieves the stated objectives in a reliable and efficient manner and which satisfies needs existing in the building construction field.

Such objectives are obtained by the hexagonal building construction comprising a primary hexagonal unit formed of a plurality of flat panel elements; the panel elements including a plurality of similar flat rectangular side wall panel elements formed with flat vertically extending edge members and top and bottom flat end members; the panel elements also including a plurality of similar flat side wall arched panel element means formed with flat vertically extending edge members, bottom flat end members, and top arched end member means having flat end portions extending upwardly angularly toward each other from the region of the upper ends of said vertically extending edge members joined at a central peak; and the panel elements also including three similar flat roof panel element means formed with a central lower member having an outer edge and an inner angularly extending flat portion, with secondary flat edge members extending angularly upwardly from each end of the central roof panel means lower member, and with an underface portion extending angularly inward from each said secondary edge member; and said secondary edge members having outer ends, and ridge edge members extending from said outer ends toward each other and joined at a top peak; the flat rectangular and arched side wall panel elements being alternately arranged in a hexagonal pattern; means directly joining adjacent flat vertically extending edge members of adjacent side wall panel elements together; means directly joining the central lower member inner angularly extending flat portion of a roof panel element means with the top flat end member of each rectangular side wall panel element; and means directly joining said underface portion extending from each secondary edge member of each roof panel element means with a flat end portion of an arched end member of an adjacent arched side wall panel element.

BRIEF DESCRIPTION OF THE DRAWINGS

Preferred embodiments of the invention—illustrative of the best mode in which applicants have contemplated applying the principles—are set forth in the following description and shown in the drawings and are particularly and distinctly pointed out and set forth in the appended claims.

FIG. 1 is a diagrammatic side view of a primary hexagonal building unit characterizing the invention;

FIG. 2 is a diagrammatic top plan view illustrating the hexagonal shape of the primary unit shown in FIG. 1;

FIG. 3 is a diagrammatic plan view illustrating a series of spaced hexagonally arranged foundation columns, piers or the like on which the primary hexagonal unit of FIG. 1 may be erected and supported;

FIG. 3A is a view of an alternate type of foundation wall for a primary unit;

FIG. 6 is an exploded view of the various components, etc., erected on a foundation shown in FIG. 1;

FIG. 19 is a perspective view of a two primary unit building having the arrangement shown in FIG. 16.

FIG. 20 is a perspective view similar to FIG. 19 illustrating a two-story building;

FIG. 21 is a perspective view of the two-cluster building illustrated in FIG. 18;

FIG. 22 is a fragmentary sectional view looking in the direction of the arrows 22—22, FIG. 21;

FIG. 23 is a fragmentary sectional view looking in the direction of the arrows 23—23, FIG. 19;

FIG. 24 is a side view showing a tension member replacing a triangular element in a passage between two joined primary units;

FIG. 25 is a fragmentary section on line 25—25, FIG. 21 showing tension means for strengthening the roof and wall structures of a primary unit; and FIG. 26 is a diagrammatic view showing the arrangement of the roof tension means in FIG. 25.

Similar numerals refer to similar parts throughout the various figures of the drawings.

DESCRIPTION OF THE PREFERRED EMBODIMENT

Figure 11:
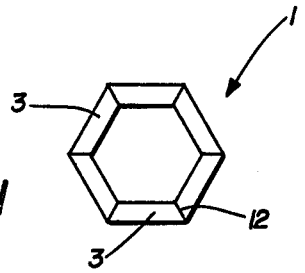
FIG. 11 is a diagrammatic view looking down on the hexagonal arrangement of flat side wall panel elements of a primary unit initially erected as a single primary unit.

The primary hexagonal building unit is indicated generally at 1 in FIGS. 1, 2 and 11. In accordance with the invention, the unit 1 is composed of a number of different flat panel elements. Each flat panel element may be formed by typical production manufacturing procedures from standard building materials. Wooden members, for example, may form the outer or peripheral top, bottom, side or end frame members of a frame which may have intermediate beams and braces. These frame members all are flat so that such members of adjacent panel elements when abutted may be joined to provide a strong joint between adjacent panel elements.

The flat outer surface of any panel element may comprise outer finishing materials usually used in building construction. The inside of any panel element may be finished with any desired material, such as plasterboard, wallboard or veneer laminate or the like also secured to the frame of the panel element.

Figures 4, 5, 5A, 5X, 7, 8, 9, 10:
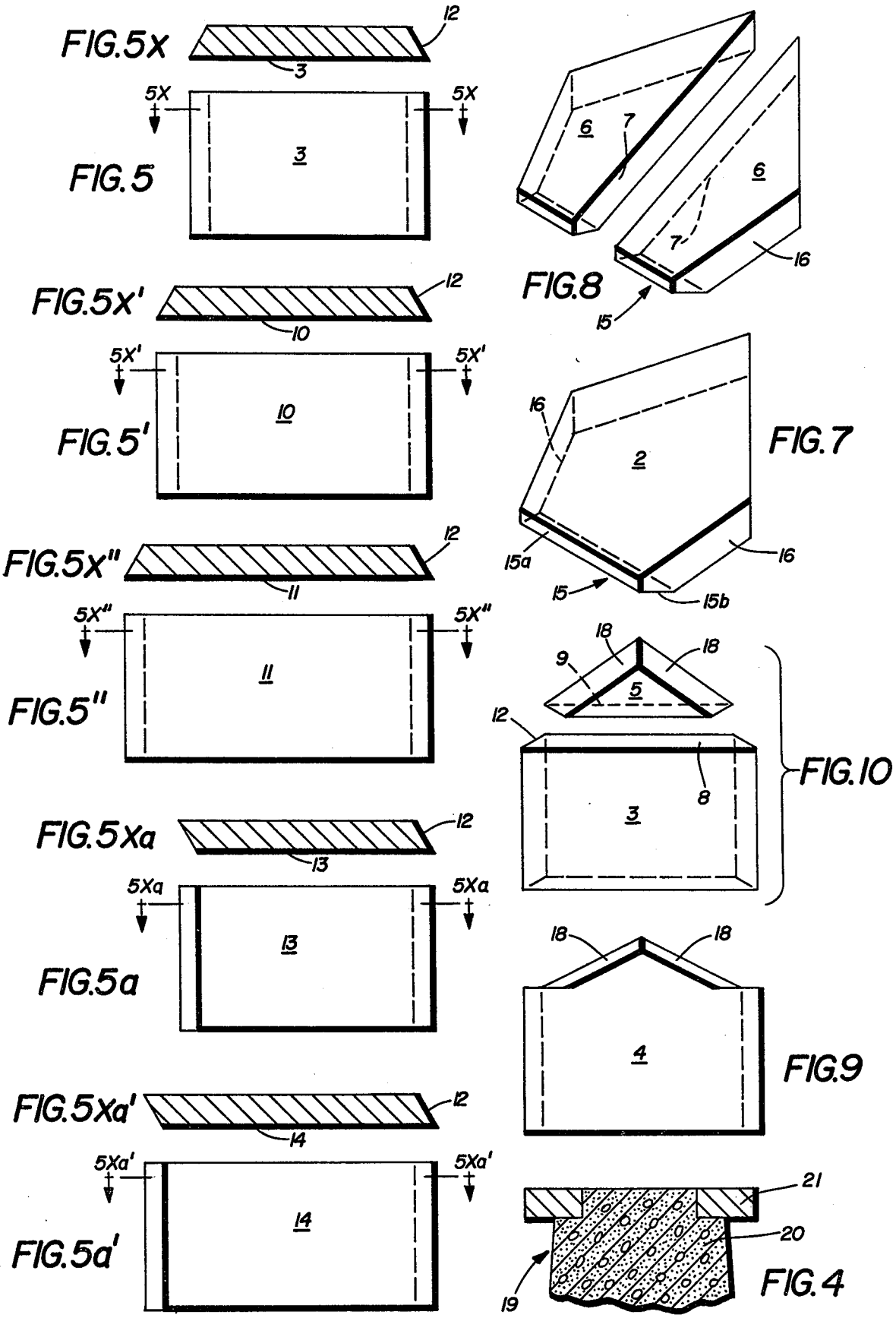
FIG. 4 is an enlarged fragmentary section of a portion of one of the piers or columns shown in FIGS. 1 and 3, looking in the direction of the arrows 4—4, FIG. 3.
FIGS. 5, 5', 5'', 5*a* and 5*a'* are side views of a series of different rectangular wall panels used in the hexagonal building construction and system of the invention.
FIGS. 5*x*, 5*x'*, 5*x''*, 5*xa* and 5*xa'* are, respectively, diagrammatic sectional views taken, respectively on the lines 5*x*, 5*x'*, 5*x''*, 5*xa* and 5*xa'* of FIGS. 5 through 5*a'*.
FIG. 7 is a perspective view of a flat roof panel element.
FIG. 8 is a perspective view similar to FIG. 7 showing the flat roof panel element formed of two complementary shaped half sections.
FIG. 9 is a side view looking at the outside surface of a flat side wall arched panel element.
FIG. 10 is an exploded perspective view of a flat arched panel element formed by a flat rectangular side wall panel element and a triangular flat arched panel element when joined at adjacent abutting edge portions.

The flat panel elements of the primary unit 1 consist of roof panel elements 2, rectangular wall panel elements 3 and angular arch panel elements 4 (FIG. 9). For convenience in manufacture, handling, storing and shipping the panel elements, and for ease of erection, the angular arch panel element 4 preferably is made in two pieces, one of which may be a rectangular wall panel element 3, and the other of which may be a triangular wall panel element 5 (FIG. 10).

Similarly, for convenience, the flat roof panel element 2 (FIG. 7) may be formed of two complementary shaped half-section panel elements 6. The roof half-section panel elements 6 form a complete flat panel element 2 by bolting together abutted flat beam edge members 7 by bolts, not shown.

Similarly, an angle arch panel member 4 (FIG. 9) is formed by bolting together the flat top end member 8 of a rectangular panel element 3, and a flat bottom edge member 9 of said triangular arched panel element 5 when abutted as generally illustrated in FIG. 1.

A primary hexagonal unit as shown in FIG. 1 has three roof panel elements 2, three rectangular wall panel elements 3, alternating around the hexagon with arched panel elements 4 (or such arched panel elements 4 formed by rectangular wall panel elements 3 to which triangular arched panel elements 5 have been connected). This is shown in FIG. 1 and is indicated in exploded relation in FIGS. 6 and 10.

For various purposes to be described, when erecting multiple unit buildings or adding units 1 to buildings formed of one or more units 1, additional panel elements may be required, including panel elements 10, 11, 13 and 14.

The medium rectangular flat wall panel element 10 is shown in FIGS. 5' and 5x' and is similar to but somewhat wider than the small rectangular flat wall panel element 3 of FIG. 5.

The long rectangular flat wall panel 11 is somewhat wider (FIG. 5'') than the medium rectangular panel 10 (FIG. 5').

The wall panel elements 3, 10 and 11 each have a trapezoidal shape in horizontal cross section presenting flat vertical extending edge members 12, angled with respect to the surfaces of the flat panels. The angular relation of the flat vertical outer edges 12 of the wall panels 3 are such that there is flat abutment between such adjacent edges 12 when assembled to form a primary unit as illustrated in FIGS. 6 and 11.

Other additional rectangular wall panel elements 13 and 14 have a parallelogram shape in horizontal cross section as shown in FIGS. 5*a* and 5*a'*. The long flat rectangular wall panel element 14 is wider than panel 13. The flat vertically extending edge members of panel elements 13 and 14 are also angularly arranged with respect to the panel surfaces as indicated at 12, similar to the angular edge members of panel elements 3, 10 and 11.

The roof panel element 2 (FIG. 7) has a flat central lower member 15 and secondary edge members 16 (FIGS. 1, 7 and 22) extending angularly upwardly from each end of the central lower member 15. Further, there is an underface portion 17 extending angularly inwardly from each secondary edge member 16 (FIG. 22) which engages a flat end portion 18 of the flat triangular panel element 5 when the panel elements are erected as best shown in FIGS. 1 and 22.

As best shown in FIG. 25 the roof panel element central lower frame member 15 has an outer edge 15*a* and an inner angularly extending flat portion 15*b*. Thus, when roof and wall panel elements are assembled, the central lower roof member inner angularly extending flat portion 15*b* may be joined by bolt means with the top flat end member 8 of a wall panel element 3.

The primary unit 1 may be erected on any desired type of foundation, preferably such as shown in FIGS. 1, 3, 3A and 6. The simplest type of foundation includes a pier or column or pile generally indicated at 19 which is located below each corner of the hexagonal shape, ordinarily including an additional pier 19 at the center of the hexagon as shown in FIGS. 3 and 6. Each pier 19 may be formed in a usual manner of reinforced concrete 20 (FIG. 4) with a hexagonally shaped ringlike metal cap 21. Such piers may extend above the ground level (FIG. 1) when the building is located near the water line of a water body.

Alternately a hexagonal wall foundation 22 (FIG. 3A) located in the ground may support a unit 1.

Before the described panel elements are assembled to erect a primary unit 1 on a foundation, a floor may be constructed on the foundation which may be of any usual construction. If desired, the floor generally indicated at 23 may be formed of six triangular floor panel elements 24 with abutting edges of the triangular panel elements bolted together in a manner generally described above.

DESCRIPTION OF SINGLE AND MULTIPLE UNIT EMBODIMENTS

A primary unit 1 initially erected as a single unit is diagrammatically shown in FIG. 11 and has six rectangular side wall panel elements 3 as indicated.

Figure 12:
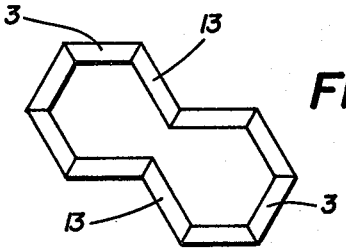
FIG. 12 is a similar view illustrating a two primary unit building initially erected as such.

FIG. 12 shows a two primary unit building constructed at one time. In this multiple unit construction, flat rectangular side wall panel elements 3 and 13 are used as indicated.

Figure 13:
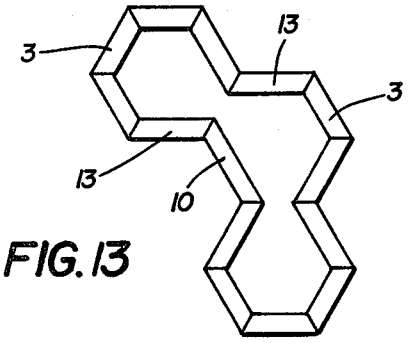
FIG. 13 is a view similar to FIGS. 11 and 12 illustrating a three primary unit building originally erected as such.

A building originally constructed combining three primary units is shown in FIG. 13. In this building rectangular side wall panel elements 3, 10 and 13 are used as indicated.

Figure 14:
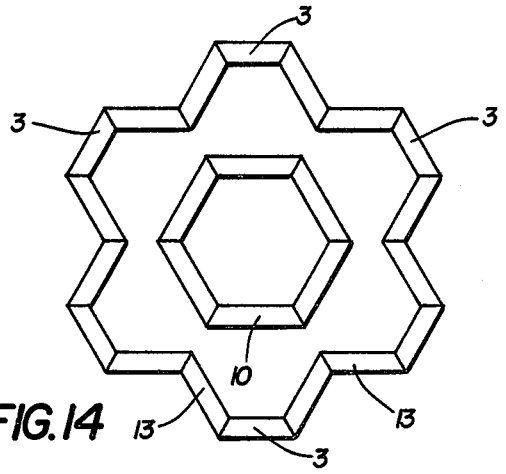
FIG. 14 is a view similar to FIGS. 11 to 13 illustrating a six primary unit building initially erected as such, and arranged with a central open court or patio.
Figure 15:
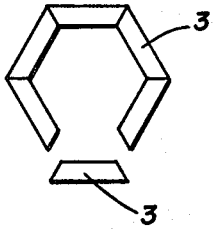
FIG. 15 is a view similar to FIG. 11 of a single primary unit being remodeled to add on one or more additional primary units.

Similarly, FIG. 14 shows a six primary unit building initially erected in a cluster shape with a central open court or patio. In this cluster building, rectangular side wall panel elements 3, 10 and 13 are used.

Where an initially constructed single primary unit such as shown in FIG. 11 is subsequently remodeled to add one or more units thereto, a rectangular side wall panel element 3 must be removed, as shown in FIG. 15. This removed panel 3 is one that forms a part of a flat side wall arched panel element or it may be a panel element 4 such as illustrated in FIG. 9. Whenever primary units are connected together in multiples, it is the openings of the two units where arched panel elements are located that are joined. If necessary a tension member 27 as shown in FIG. 24 may replace triangular panel element 5 where two units are joined to form an arched opening.

Figure 16:
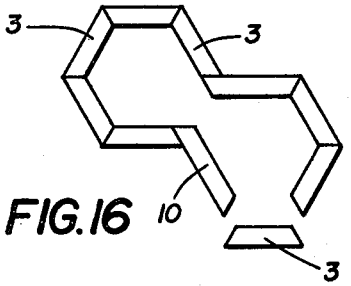
FIG. 16 is a view similar to FIG. 15 showing a second primary unit added onto the unit shown in FIG. 15 and in process of having a third unit subsequently added to the units shown.

Thus, in modifying a single unit 1 as shown in FIG. 15 to form a two unit building as shown in FIG. 16, the arched panel element 4, or instead rectangular element 3 is removed and trapezoidal rectangular wall panel elements 10 are used in the added unit to join the initial unit as shown in FIG. 16. Thus, the two unit buildings illustrated in FIGS. 12 and 16 have a slightly different assembly of wall panels, wall panels 3 and 10 being used when the units are added together in FIG. 16 while wall panel units 3 and 13 are used when the two unit structure is built at one time as in FIG. 12.

Figure 17:
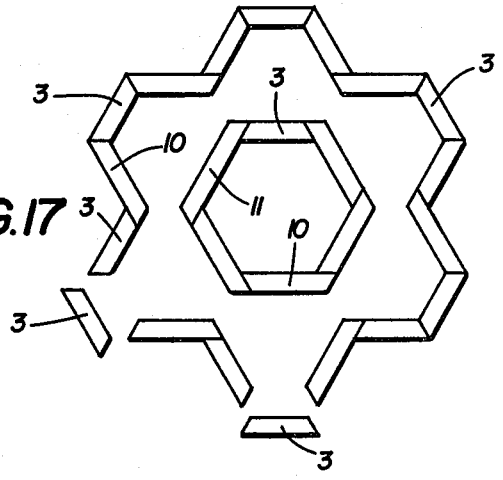
FIG. 17 shows a building similar in shape to that of FIG. 14 built by adding one primary unit at a time, and in process of adding additional units.
Figure 18:
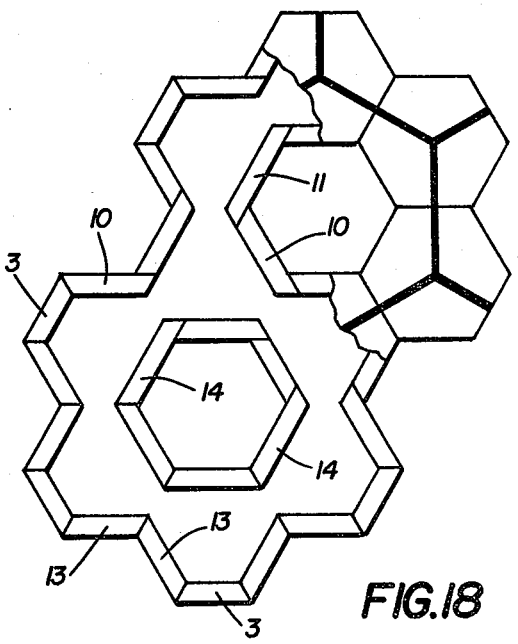
FIG. 18 is a view similar to FIG. 17 having additional units added to the building of FIG. 17 forming a double cluster with two central courts or patios.

The cluster building of FIG. 17 illustrates the different side wall panel elements used where multiple buildings have been formed by adding on additional units at later dates and where there may be a cluster add-on as indicated by removed panel elements in FIG. 17. Thus, the cluster building of FIG. 17 includes various side wall panel elements 3, 10 and 11. Furthermore, in the double cluster arrangement of FIG. 18, side wall panel elements 3, 10, 11–13 and 14 may be used.

Where two primary units are formed by adding on, such as shown in FIGS. 16, 19 and 23, side wall panel elements 3 and 10 are used. In this instance the joint between adjacent abutted panel surfaces between panel elements 3 and 10 (FIG. 23) is formed by abutting an edge member 12 of panel element 3 and an outer panel face portion 25 of panel 10 as illustrated in FIG. 23.

Fragmentary portions of inner panel surface finishing materials are broken away in FIG. 6 to show bolt means 26 joining abutted vertical members of adjacent panels 3, representative of joining all abutted members in a unit 1.

The building of FIG. 20 illustrates the manner in which a two-story multiple unit building may be constructed using a typical side wall arrangement as shown in FIG. 12 in the lower story, an intervening floor 23 for the floor of the second story and a second story side wall similar to the first story with the typical roof.

The double cluster building of FIG. 21 illustrates the manner in which there is roof drainage from all portions of the multiple unit building, the roof panel elements 2 sloping downward to each of the central courts or patios draining inward to the open area from their surfaces and inward and outward from the inclined joints between adjacent roof panel elements of adjacent units.

Where needed for strengthening the unit 1 at the joints between side wall and roof panel elements, tension members 28 may be anchored at one end to the midpoint of the lower central member 15 of each roof element 2, and attached at the other end to a ring device 29 located in the center of the unit 1 as shown in FIGS. 25 and 26.

Accordingly, the new construction provides an improved primary hexagonal building unit and system of constructing initially, and by adding additional units from time to time, multiple unit structures which provide roof drainage and provides simple, readily sealed directly bolted joints between adjacent panel elements and which achieves the stated objectives, eliminates difficulties existing in the prior art where buildings formed of complicated fabricated and difficult to install panel units have been proposed, and which solve problems and obtain the described new results.

In the foregoing description, certain terms have been used for brevity, clearness and understanding, but no unnecessary limitations are to be implied therefrom beyond the requirements of the prior art because such terms are used for descriptive purposes and are intended to be broadly construed.

Moreover, the description and illustration of the invention is by way of example, and the scope of the invention is not limited to the exact details shown or described.

Having now described the features, discoveries, and principles of the invention, the manner in which the buildings are constructed and the add-on and multiple unit systems, and the advantageous, new and useful results obtained; the new and useful structures, devices, elements, arrangements, parts, combinations, systems and relationships are set forth in the appended claims.

We claim:

1. Hexagonal building construction comprising a primary hexagonal unit formed of a plurality of flat panel elements; the panel elements including a plurality of similar flat rectangular side wall panel elements formed with flat vertically extending edge members and top and bottom flat end members; the panel elements also including a plurality of similar flat side wall arch panel elements formed with flat vertically extending edge members, bottom flat end members, and top arch end members having flat end portions extending upwardly angularly toward each other from regions of upper ends of said vertically extending edge members and merging at a central peak; and the panel elements also including three similar flat roof panel elements formed with a central lower member having an outer edge and an inner angularly extending flat portion, with secondary flat edge members extending angularly upwardly from each end of said central roof panel lower member, and with an underface portion extending angularly inward from each said secondary edge member; and said secondary edge members having outer ends, and ridge edge members extending from said outer ends toward each other and merging at a top peak; the flat rectangular and arch side wall panel elements being alternately arranged in a hexagonal pattern; means directly joining adjacent flat vertically extending edge members of adjacent side wall panel elements together; means directly joining the central lower member inner angularly extending flat portion of a roof panel element means with the top flat end member of each rectangular side wall panel element; and means directly joining said underface portion extending from each secondary edge member of each roof panel element with a flat end portion of an arch end member of an adjacent arch side wall panel element.

2. The construction defined in claim 1 in which there are three similar flat rectangular side wall panel elements; and in which there are three similar flat side wall arch panel element means.

3. The construction defined in claim 1 in which multiple primary units are connected together; in which the connection between any pair of adjacent units is formed by abutting the spaced, flat, vertically extending edge members of two spaced rectangular side wall panel elements of one of the adjacent units, with the similarly spaced, flat, vertically extending edge members of two spaced rectangular side wall panel elements of the other adjacent unit, thereby providing two spaced pairs of abutted vertically extending side wall edge members which form a passage between said pair of adjacent units; and in which there is means directly joining together the pair of abutted edge members of each of said spaced pairs.

4. The construction defined in claim 3 in which said side wall panel elements in horizontal cross section have a shape of at least one of a class consisting of a trapezoid and a parallelogram.

* * * * *